US006875046B2

(12) United States Patent
Chiu et al.

(10) Patent No.: US 6,875,046 B2
(45) Date of Patent: Apr. 5, 2005

(54) ELECTRICAL CONNECTOR WITH TWISTED PAIR STRAIN RELIEF

(76) Inventors: Hung-Jen Chiu, No. 39, Chuan-Ya Tso, Tai-Shang Hsiang, Taipei Hsien (TW); Keith Tharp, 1014 Normington Way, San Jose, CA (US) 95136

( * ) Notice: Subject to any disclaimer, the term of this patent is extended or adjusted under 35 U.S.C. 154(b) by 0 days.

(21) Appl. No.: 10/370,514

(22) Filed: Feb. 24, 2003

(65) Prior Publication Data

US 2004/0166742 A1 Aug. 26, 2004

(51) Int. Cl.[7] ..... H01R 13/58
(52) U.S. Cl. ..... 439/460; 439/942
(58) Field of Search ..... 439/492–494, 439/499, 460, 418, 731, 876, 941, 942

(56) References Cited

U.S. PATENT DOCUMENTS 6,648,673 B2 * 11/2003 Watanabe ..... 439/457
6,685,495 B1 * 2/2004 Ko ..... 439/353

* cited by examiner

*Primary Examiner*—Khiem Nguyen
(74) *Attorney, Agent, or Firm*—Lowe, Hauptman & Berner, LLP

(57) ABSTRACT

A cable connector includes a plurality of terminals mounted inside an insulative housing and having solder sections extending outwardly of the housing for connection with a bulk cable having twisted pairs of wires. A twist pair strain relief device is disposed adjacent to the solder sections, and has an insulative body which has a first side facing the solder sections and an opposite second side. A plurality of passages are formed in the body to receive the respective twisted pairs in a twisted state. Each passage has a clamping unit to clamp the corresponding twisted pair so as to prevent the pair from being untwisted and to act as a strain relief when the twisted pairs are subjected to external forces.

12 Claims, 3 Drawing Sheets

ELECTRICAL CONNECTOR WITH TWISTED PAIR STRAIN RELIEF

BACKGROUND OF THE INVENTION

1. Field of the Invention

The invention relates to an electrical connector, more particularly to an electrical connector having terminals terminated to twisted pairs of wires.

2. Description of the Related Art

In order to ensure good performance of high data transmission connectors with twisted pair cabling, test methods are provided to measure the transmission characteristics of connectors, such as connector attenuation and cross-talk.

Attenuation is a measure of signal power loss through a cable and connector at various frequencies, and is derived from swept frequency voltage measurements on short lengths of twisted pair test leads, such as 100 ohm and other impedances. The lower the attenuation value, the better the attenuation performance.

Crosstalk is a measure of signal coupling from one pair to another within a connector at various frequencies. The lower the crosstalk value, the better the crosstalk performance.

From tests of the aforesaid transmission characteristics, it is noted that the performance of a twisted pair connector is greatly improved when the twists of the paired wires are maintained as close as possible to the point of termination where the exposed conductors of the wires are terminated to the respective terminals.

FIGS. 1, 2 and 3 show a typical cable connector which includes two rows of terminals 11 installed within a connector housing 10 for electrical connection with a cable 12. The cable 12 has a portion of shielding 13 which is cut off to expose a plurality of pairs of wires 14. The paired wires 14 are originally twisted within the sheathing 13 and are untwisted into individuals so as to be positioned to two adhesive tapes 15 in an order corresponding to that of the respective terminals 11 which are aligned in two rows. Each pair of wires 14 are separated and are respectively attached to the two adhesive tapes 15, and each adhesive tape 15 is folded into two layers to sandwich the wires 14 as best shown in FIG. 3. The wires 14 attached to the upper adhesive tape 15 are soldered to the respective terminals 11 in the upper row, whereas the wires 14 attached to the lower adhesive tape 15 are soldered to the respective terminals 11 in the lower row. Since the paired wires 14 are untwisted for a considerable length before reaching the point of termination, a crosstalk problem is observed when the transmission characteristics of this cable connector are tested. It is desirable to minimize the crosstalk problem encountered with such a cable connector.

SUMMARY OF THE INVENTION

An objective of the present invention is to provide a cable connector with improved transmission characteristics by maintaining twisted pairs of wires as close as possible to the point of termination.

Another objective of the present invention is to provide a twist pair stain relief device to maintain the twists of the paired wires and to prevent the twisted pairs from being untwisted due to external forces.

According to one aspect of the present invention, a cable connector according to the present invention comprises: an insulative housing; a plurality of terminals mounted within the housing and having solder sections extending outwardly of the housing; a bulk cable having a plurality of twisted pairs of wires; and a twist pair strain relief device disposed adjacent to the solder sections of the terminals and including a body which has a first side facing the solder sections, a second side opposite to the first side, a plurality of passages extending between and opening at the first and second sides, and a clamping unit disposed in each of the passages. Each of the twisted pairs extends into and through a corresponding one of the passages in a twisted state, and the clamping unit clamps and prevents the corresponding one of the twisted pairs from being untwisted into individual wires. The twisted pairs have wire portions extending out of the passages through the first side and then connected electrically and respectively to the solder sections of the terminals.

According to another aspect of the invention, a twist pair strain relief device for a cable connector, comprises: a twist pair strain relief device including a body which has a first side, and a second side opposite to the first side, a plurality of passages extending between and opening at the first and second sides, and a clamping unit disposed in each of the passages; and a bulk cable having a plurality of twisted pairs of wires, wherein each of the twisted pairs extends into and through a corresponding one of the passages in a twisted state, and the clamping unit clamps and prevents the corresponding one of the twisted pairs from being untwisted into individuals, the twisted pairs having wire portions extending out of the passages through the first and second sides.

By providing the twist pair strain relief device adjacent to the solder sections of the terminals, the twists of the paired wires can be maintained as close as possible to the point of termination of the wires to the terminals. As such, integrity impedance or discontinuity can be minimized between the bulk cable and the connector.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
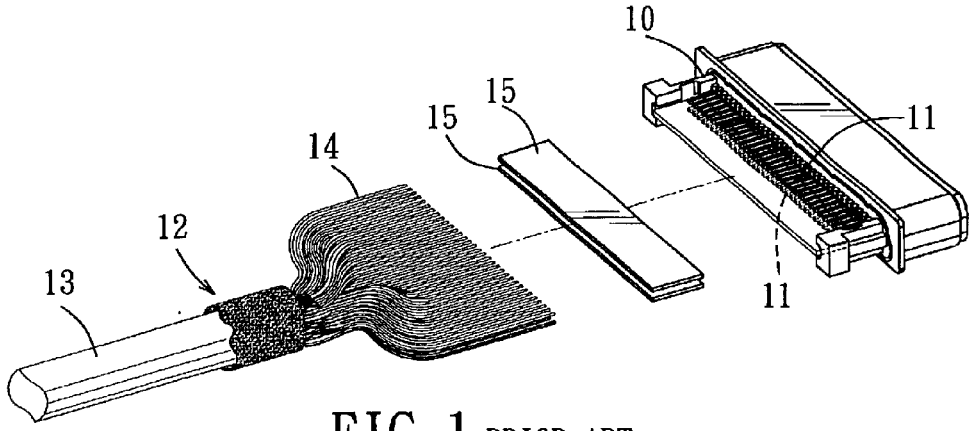
FIG. 1 PRIOR ART
FIG. 1 is an exploded view of a conventional cable connector.
Figure 2:
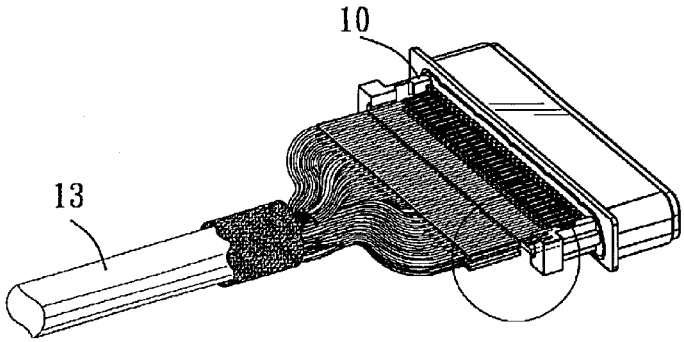
FIG. 2 PRIOR ART
FIG. 2 is a perspective view showing the conventional cable connector of FIG. 1 in an assembled state.
Figure 3:
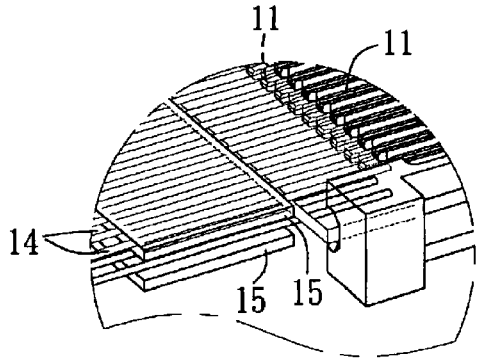
FIG. 3 PRIOR ART
FIG. 3 is a fragmentary perspective view of the conventional cable connector of FIG. 1.
Figure 4:
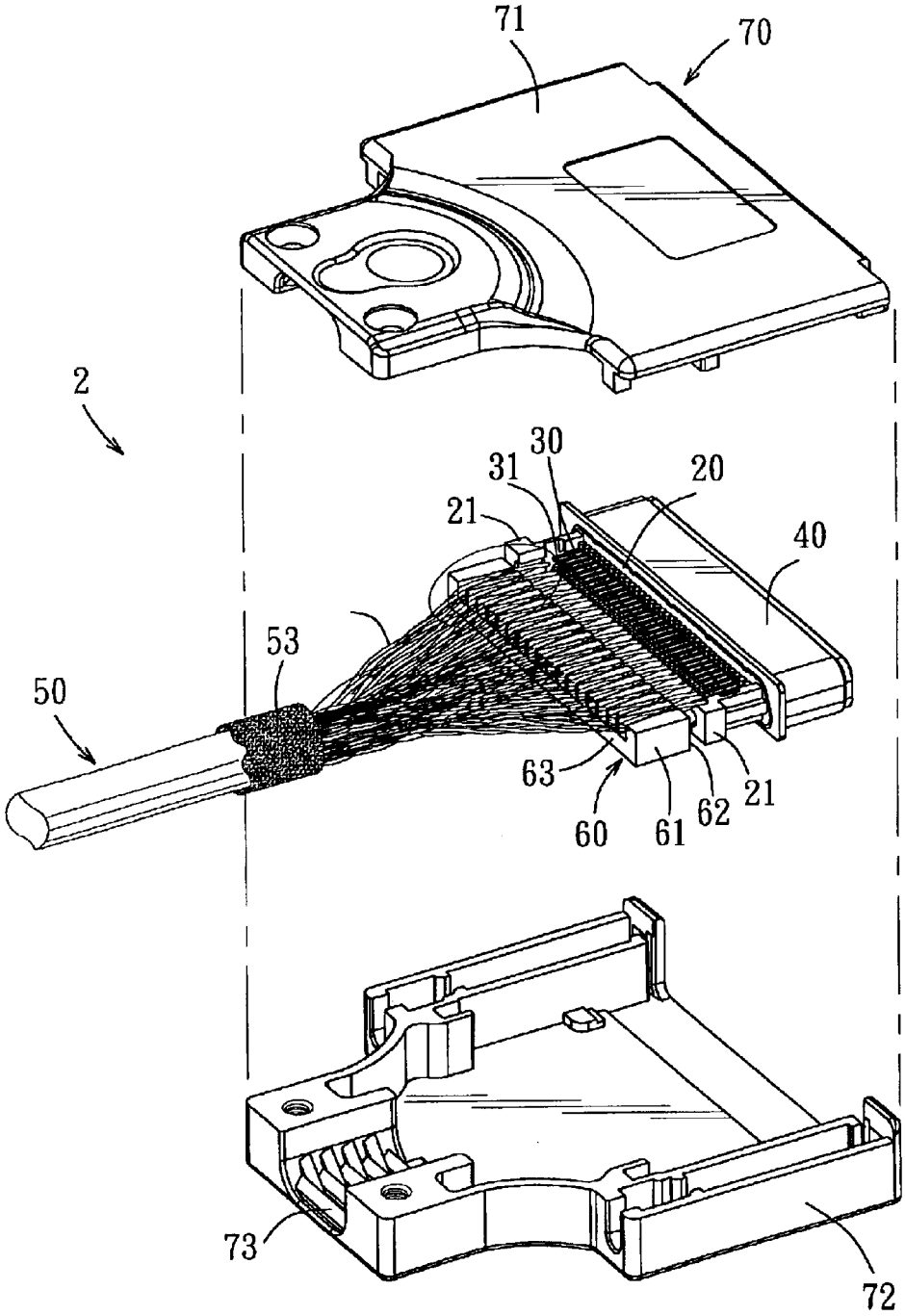
FIG. 4 is an exploded view of a preferred embodiment of a cable connector according to the present invention.
Figure 5:
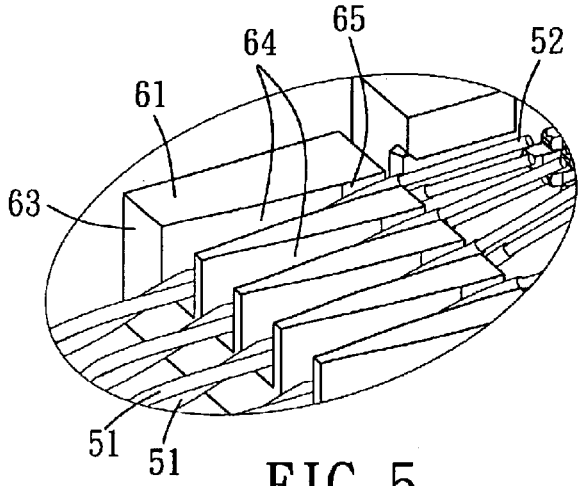
FIG. 5 is a fragmentary perspective view showing a portion of the twist pair strain relief device encircled in FIG. 4.
Figure 6:
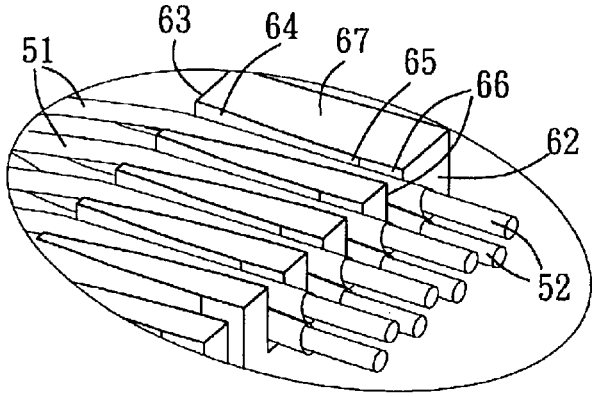
FIG. 6 is another fragmentary perspective view showing the same portion of the twist pair strain relief device as FIG. 5 but viewed in a different direction.

Referring to FIGS. 4, 5 and 6, the preferred embodiment of a cable connector according to the present invention is shown at 2 and includes an insulative housing 21 and a plurality of terminals 30 mounted inside the housing 20. In particular, the insulative housing 20 is elongated and has two rearwardly extending arms 21. The terminals 30 are arranged in upper and lower rows and have solder sections 31 extending outwardly from a rear end of the insulative housing 20 between the two arms 21. A shielding shroud 40 which is made of metal, encloses the front portion of the housing 20 and front contact sections (not shown) of the terminals 30.

The solder sections 31 of the terminals 30 are connected to a bulk cable 50 which has a plurality of twisted pairs of wires 51. In order to maintain the twists of the paired wires 51 as close as possible to the point of termination thereof, a twist pair strain relief device 60 is disposed at the rear of the solder sections 31 of the terminals 30. The twist pair strain relief device 60 has an insulative body 61 with a first side 62 facing the solder sections 31 of the terminals 30, a second side 63 opposite to the first side 62, and a third side 67 (see FIG. 6) interconnecting the first and second sides 62, 63. A plurality of passages 64 extend between and open at the first, second and third sides 62, 63 and 67. If desired, a cover (not shown) may be attached to the third side 67 to cover the passages 64. The twist pair strain relief device 60 further has a clamping unit disposed in each passage 64. In this embodiment, the clamping unit is composed of an opposed pair of clamping walls 66 formed within each passage 64 adjacent to the first side 62. Specifically, each passage 64 is tapered toward the first side 62 to form a constricted section 65. The constricted section 65 is defined by two substantially parallel clamp walls 66 spaced at a distance which is slightly smaller than the cross-section of the individual wires 51.

The twisted pairs of wires 51 are exposed after a portion of an insulation of the cable 50 is removed and are placed within the respective passages 64 of the twist pair strain relief device 60. Each twisted pair of wires 51 therefore extends through the corresponding passage 64 and exits from the first side 62 of the insulative body 61. The clamp walls 66 clamp the twisted pair of wires 51 so that the wires 51 are prevented from being untwisted into individual wires. Preferably, the clamp walls 66 are formed closely adjacent to the first side 62 so that the twists of the paired wires 51 are maintained as close as possible to the point of termination thereof.

After exiting from the first side 62, the twisted pairs of wires 51 are untwisted and the sheathings of the wires 51 are stripped to expose the conductors 52 thereof. The exposed conductors 52 are then soldered to the respective solder sections 31 of the terminals 30.

The connector 2 further includes a metal shielding case 70 which has an upper half 71 and a lower half 72 assembled together to encase the rear part of the housing 20, the twist pair strain relief device 60 and portions of the twisted pairs of wires 51. Rear ends of the upper and lower halves 71, 72 close around a cable strain relief member 53 that is disposed around the cable 50. The cable strain relief member 53 frictionally engages ridges 73 formed on the upper and lower halves 71 and 72 so as to serve as a strain relief when the cable 50 is subjected to a pulling force.

Figure 7:
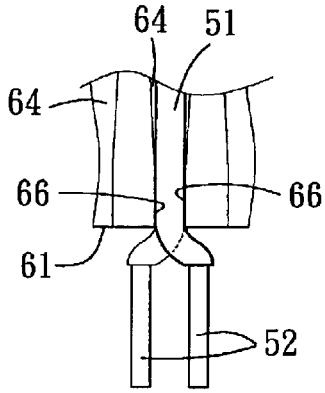
FIG. 7 is a fragmentary plan view of a portion of the twist pair strain relief device.

As best shown in FIG. 6, the wires 51 in each pair are placed one above another between the clamp walls 66 of the constricted section 65 of the corresponding passage 64 so that the order of the wires 51 corresponds to that of the solder sections 31 of the two corresponding terminals 30, which are respectively arranged in the upper and lower rows. However, in case the two corresponding terminals 31 are arranged in the same row, the paired wires 51, which are placed one above another between the clamp walls 66, may be turned so as to be aligned horizontally after exiting from the first side 62 of the insulative body 61 as shown in FIG. 7. Due to the presence of the clamp walls 66, the original twist of the wires 51 can still be maintained.

The clamp walls 66 not only prevent the wires 51 from being untwisted but also act as a strain relief when the wires 51 experience external forces. Stresses can be induced when tools are used to cut the wires 51 exiting from the first side 62 or to strip the sheathings thereof to expose conductors 52. These stresses can be transferred to the clamp walls 66 or the clamping unit of the twist pair strain relief device 60 so that they will not act on the twisted pairs of wires 51 and so that the original twists of the paired wires 51 can be maintained within the respective passages 64.

While each clamping unit of the twist pair strain relief device 60 in this embodiment is configured as the clamp walls 66 of the constricted section 65 of the passage 64, the construction of the clamping unit is not limited thereto. The clamping unit may be in any suitable form which can be incorporated into the walls of the corresponding passage 64 to provide a clamping force to the twisted pair of wires 51.

Alternatively, the twist pair strain relief device according to the present invention may include, in place of the insulative body 61, an insert-molded body which is molded over the twisted pairs of wires in such a manner that portions of the twisted pairs are inserted into and are clamped by the insert-molded body and that the twisted pairs extend out of the insert-molded body at two opposed sides of the insert-molded body. Like the clamping unit of the insulative body 61, the insert-molded body can provide a clamping force to maintain the twists of the wires.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A cable connector comprising:

an insulative housing;

a plurality of terminals mounted within said housing and having solder sections extending outwardly of said housing;

a bulk cable having a plurality of twisted pairs of wires; and a twisted pair strain relief device disposed adjacent to said solder sections of said terminals and including a body which has a first side facing said solder sections, a second side opposite to said first side, and a plurality of passages extending between and opening at said first and second sides, each of said passages having a constricted section immediately adjacent to said first side, wherein each of said twisted pairs extends into and through a corresponding one of said passages in a twisted state, and said constricted section clamps and prevents the corresponding one of said twisted pairs from being untwisted into individuals, said twisted pairs having wire portions extending out of said passages through said first side and then connected electrically and respectively to said solder sections of said terminals.

2. The cable connector as claimed in claim 1, wherein each of said passages is tapered toward said first side to form said constricted section, said constricted section having two opposite clamp walls.

3. The cable connector as claimed in claim 1, wherein said body further has a third side interconnecting said first and second sides, said passages further opening at said third side.

4. The cable connector as claimed in claim 1, wherein said body of said twisted pair strain relief device is an insulative body.

5. A twisted pair strain relief device for a cable connector, comprising:

a body having a first side, a second side opposite to said first side, and a plurality of passages extending between and opening at said first and second sides, each of said passages having a constricted section immediately adjacent to said first side; and a bulk cable having a plurality of twisted pairs of wires, wherein each of said twisted pairs extends into and through a corresponding one of said passages in a twisted state, and said constricted section clamps and prevents the corresponding one of said twisted pairs from being untwisted into individuals, said twisted pairs having wire portions extending out of said passages through said first and second sides.

6. The twisted pair strain relief device as claimed in claim 5, wherein each of said passages is tapered toward said first side to form said constricted section, said constricted section having two opposite clamp walls.

7. A twisted pair strain relief device for a cable connector, comprising:

a body having a first side, a second side opposite to said first side, and a plurality of passages extending between and opening at said first and second sides, each of said passages having a constricted section immediately adjacent to said first side, each of said passages being adapted to receive a bulk cable having a plurality of twisted pairs of wires and arranged for enabling each of said twisted pairs to extend into and through a corresponding one of said passages in a twisted state, and said constricted section being arranged for clamping and preventing the corresponding one of the twisted pairs from being untwisted into individuals and for enabling said twisted pairs to have portions extending out of said passages through said first and second sides.

8. The twisted pair strain relief device as claimed in claim 7, wherein each of said passages is tapered toward said first side to form said constricted section, said constricted section having two opposite clamp walls.

9. A cable connector including the twisted pair relief device of claim 8, and further including:

an insulative housing; and a plurality of terminals mounted within said housing and having the twisted pair strain relief device being disposed adjacent to said solder sections of said terminals, a first side of the body facing said solder sections.

10. The twisted pair strain relief device as claimed in claim 7, wherein each of said passages is tapered toward said first side to form said constricted section, said constricted section having two opposite clamp walls.

11. The twisted pair strain relief device as claimed in claim 7, wherein said body further has a third side interconnecting said first and second sides, said passages further opening at said third side.

12. The twisted pair strain relief device as claimed in claim 7, wherein said body of said twist pair strain relief device is an insulative body.

* * * * *